US007570910B2

(12) United States Patent
Ishii

(10) Patent No.: US 7,570,910 B2
(45) Date of Patent: Aug. 4, 2009

(54) IMAGE FORMING APPARATUS, FIXING UNIT, AND IMAGE FORMING METHOD USING INDUCTION HEATER

(75) Inventor: Kenji Ishii, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

(21) Appl. No.: 11/453,035

(22) Filed: Jun. 15, 2006

(65) Prior Publication Data

US 2006/0285893 A1 Dec. 21, 2006

(30) Foreign Application Priority Data

Jun. 17, 2005 (JP) ..... 2005-177324

(51) Int. Cl.
*G03G 15/20* (2006.01)

(52) U.S. Cl. ..... 399/329; 399/328

(58) Field of Classification Search ..... 399/328, 399/329, 330; 219/619
See application file for complete search history.

(56) References Cited

U.S. PATENT DOCUMENTS

| | | | | |
|---|---|---|---|---|
| 6,347,201 | B1 * | 2/2002 | Sano et al. | 399/328 |
| 6,449,457 | B2 * | 9/2002 | Samei et al. | 399/328 |
| 7,079,800 | B2 * | 7/2006 | Asakura et al. | 399/328 |
| 2006/0029411 | A1 | 2/2006 | Ishii et al. | |

FOREIGN PATENT DOCUMENTS

| | | |
|---|---|---|
| EP | 1582939 | * 10/2005 |
| JP | 08-137306 | 5/1996 |
| JP | 2002-006658 | 1/2002 |
| JP | 2002-124371 | 4/2002 |
| JP | 2002-270356 | 9/2002 |
| JP | 2003-131508 | 5/2003 |
| JP | 2003-263045 | 9/2003 |
| JP | 2004-145368 | 5/2004 |
| JP | 2005-070376 | 3/2005 |

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes an image forming mechanism configured to form a toner image on a recording medium according to image data and a fixing mechanism configured to fix the toner image on the recording medium. The fixing mechanism includes an induction heater, a heat generator, and a position adjusting mechanism. The induction heater is configured to generate a magnetic flux. The heat generator is disposed at a position opposite to the induction heater and is configured to generate heat by the magnetic flux generated by the induction heater. The position adjusting mechanism is configured to adjust a position of the induction heater in conjunction with a displacement of the heat generator.

15 Claims, 5 Drawing Sheets

IMAGE FORMING APPARATUS, FIXING UNIT, AND IMAGE FORMING METHOD USING INDUCTION HEATER

CROSS-REFERENCE TO RELATED APPLICATION

The present application is based on and claims priority to Japanese patent application No. 2005-177324 filed on Jun. 17, 2005 in the Japan Patent Office, the entire contents of which are hereby incorporated herein by reference.

BACKGROUND

1. Field of Invention

Exemplary aspects of the present invention relate to an image forming apparatus, a fixing unit, and an image forming method, and more particularly to an image forming apparatus, a fixing unit, and an image forming method using an induction heater.

2. Description of Related Art

A related art electro photographic image forming apparatus, such as a copying machine, a printer, or a facsimile machine, generally forms an electrostatic latent image on a photoconductor according to image data. The electrostatic latent image is visualized with toner to form a toner image on the photoconductor. The toner image is transferred onto a sheet and the sheet having the toner image is conveyed to a fixing unit in which heat and pressure fix the toner image on the sheet.

Such a fixing unit may use an induction heating method which can generate heat required for a fixing operation within a decreased time period so as to reduce energy consumption. Specifically, one example of a related art fixing unit includes a support roller, an auxiliary fixing roller, a fixing belt looped over the support roller and the auxiliary fixing roller, an induction heater opposing the support roller via the fixing belt, and a pressure roller pressingly opposing the auxiliary fixing roller via the fixing belt. The induction heater includes a coil which extends in a width direction of the fixing belt (i.e., in a direction perpendicular to a sheet conveyance direction) and a core opposing the coil.

A high-frequency alternating current is applied to the coil to form an alternating magnetic field around the coil. The alternating magnetic field induces an eddy current near a surface of the support roller. An electric resistance of the support roller generates Joule heat. The Joule heat is transferred from the support roller to the fixing belt while the rotating fixing belt passes under the induction heater opposing the support roller. The heated fixing belt heats the sheet having the toner image and fixes the toner image on the sheet while the sheet is conveyed through a nip formed under pressure between the pressure roller and the auxiliary fixing roller opposing to each other via the fixing belt.

In the fixing unit using the induction heating method, the support roller is directly heated by induction heating, providing an enhanced heat exchange efficiency. That is, the fixing belt can have a target fixing temperature on a surface thereof in a decreased time period with a reduced energy consumption. At the same time, however, the auxiliary fixing roller may be deformed, that is, thermally expanded due to heat transferred from the fixing belt, resulting in a change of a position of the support roller relative to the induction heater. This leads to variations of heat generating efficiencies of the support roller.

SUMMARY

Described below is an image forming apparatus according to an exemplary embodiment of the invention. In one aspect of the present invention, the image forming apparatus includes an image forming mechanism configured to form a toner image on a recording medium according to image data and a fixing mechanism configured to fix the toner image on the recording medium. The fixing mechanism includes an induction heater, a heat generator, and a position adjusting mechanism. The induction heater is configured to generate a magnetic flux. The heat generator is disposed at a position opposite to the induction heater and is configured to generate heat by the magnetic flux generated by the induction heater. The position adjusting mechanism is configured to adjust a position of the induction heater in conjunction with a displacement of the heat generator.

This specification further describes a fixing unit for fixing a toner image on a recording medium. In one aspect of the present invention, the novel fixing unit includes an induction heater, a heat generator, and a position adjusting mechanism. The induction heater is configured to generate a magnetic flux. The heat generator is disposed at a position opposite to the induction heater and is configured to generate heat by the magnetic flux generated by the induction heater. The position adjusting mechanism is configured to adjust a position of the induction heater in conjunction with a displacement of the heat generator.

This specification further describes an image forming method according to an exemplary embodiment of the invention. In one aspect of the present invention, the novel image forming method includes forming a toner image on a recording medium according to image data, transporting the recording medium having the toner image thereon, causing an induction heater to produce a magnetic flux toward a heat generator to generate heat therefrom, and adjusting a position of the induction heater in conjunction with a displacement of a heat generator.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
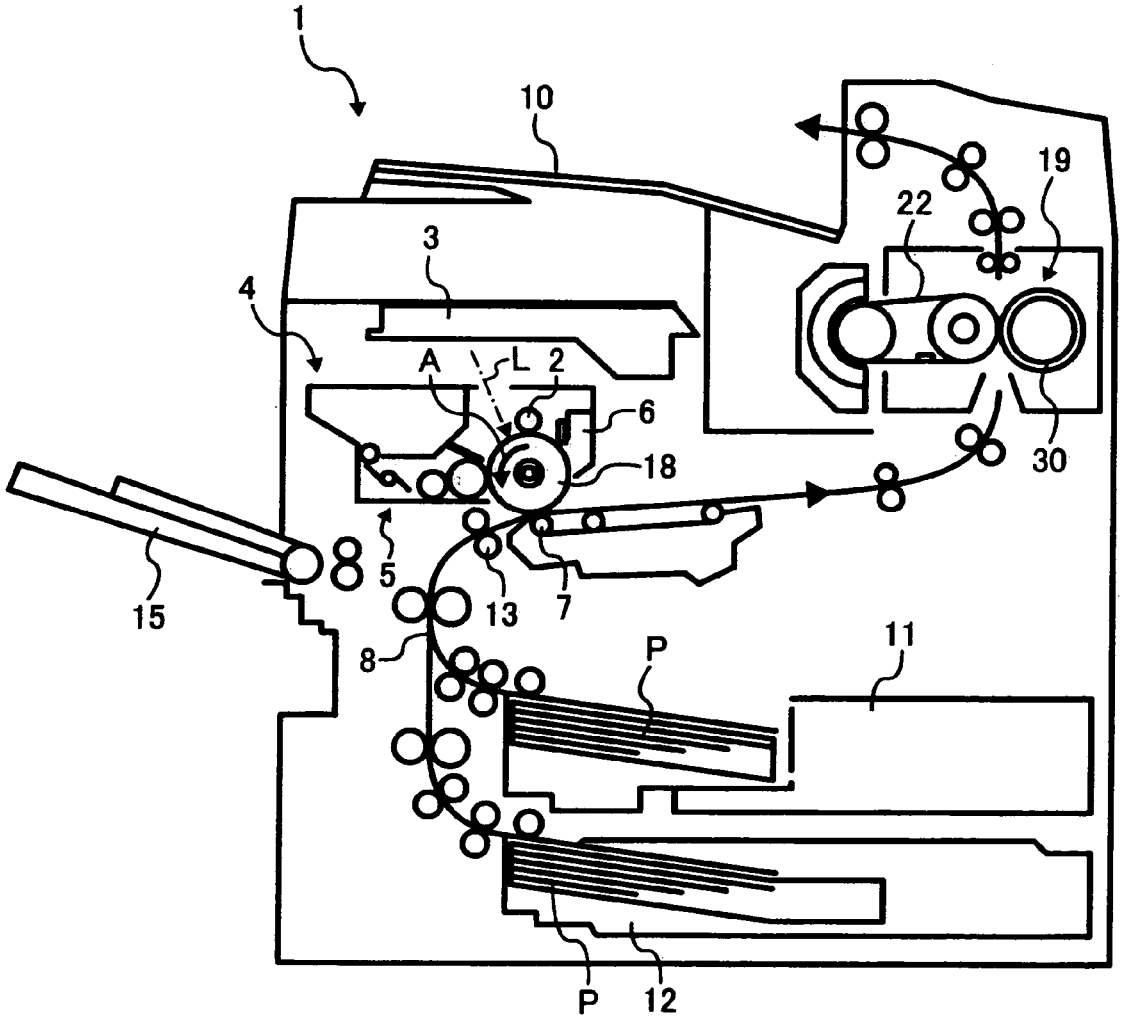
FIG. 1 is a schematic view of an image forming apparatus according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, and particularly to FIG. 1, an image forming apparatus 1 according to an exemplary embodiment of the present invention is explained.

As illustrated in FIG. 1, the image forming apparatus 1 includes a process cartridge 4, an exposure unit 3, paper trays 11 and 12, a bypass tray 15, a conveyance path 8, a registration roller 13, a transferor 7, a fixing unit 19, and an output tray 10. The process cartridge 4 includes a photoconductor 18, a charger 2, a development unit 5, and a cleaning unit 6. The fixing unit 19 includes a pressure roller 30 and a fixing belt 22.

The image forming apparatus 1 forms an image in an electro photographic method. According to this non-limiting exemplary embodiment, the image forming apparatus 1 functions as a laser printer. The process cartridge 4 is attachable to and detachable from the image forming apparatus 1. The photoconductor 18 rotates in a rotating direction A. The charger 2 uniformly charges a surface of the photoconductor 18. The exposure unit 3 irradiates light L (e.g., a laser beam) onto the surface of the photoconductor 18 to form an electrostatic latent image according to image data. The development unit 5 contains a developer (e.g., toner) and visualizes the electrostatic latent image formed on the surface of the photoconductor 18 with toner to form a toner image.

The paper tray 11, the paper tray 12, and the bypass tray 15 load a recording medium (i.e., recording sheets P). An uppermost recording sheet P is fed from the paper tray 11, the paper tray 12, or the bypass tray 15, which is automatically or manually selected, toward the conveyance path 8. The recording sheet P is further fed toward the registration roller 13. The registration roller 13 feeds the recording sheet P toward the transferor 7 at a timing when the toner image formed on the surface of the photoconductor 18 is properly transferred onto the recording sheet P. The transferor 7 transfers the toner image formed on the surface of the photoconductor 18 onto the recording sheet P. The cleaning unit 6 removes residual toner not transferred and remaining on the surface of the photoconductor 18. The recording sheet P having the toner image is further fed toward the fixing unit 19.

In the fixing unit 19, the pressure roller 30 opposes the fixing belt 22. While the recording sheet P is conveyed through a nip formed under pressure between fixing belt 22 and the pressure roller 30, heat applied by the fixing belt 22 and pressure applied by the pressure roller 30 fix the toner image on the recording sheet P. The recording sheet P having the fixed toner image is fed onto the output tray 10.

Figure 2:
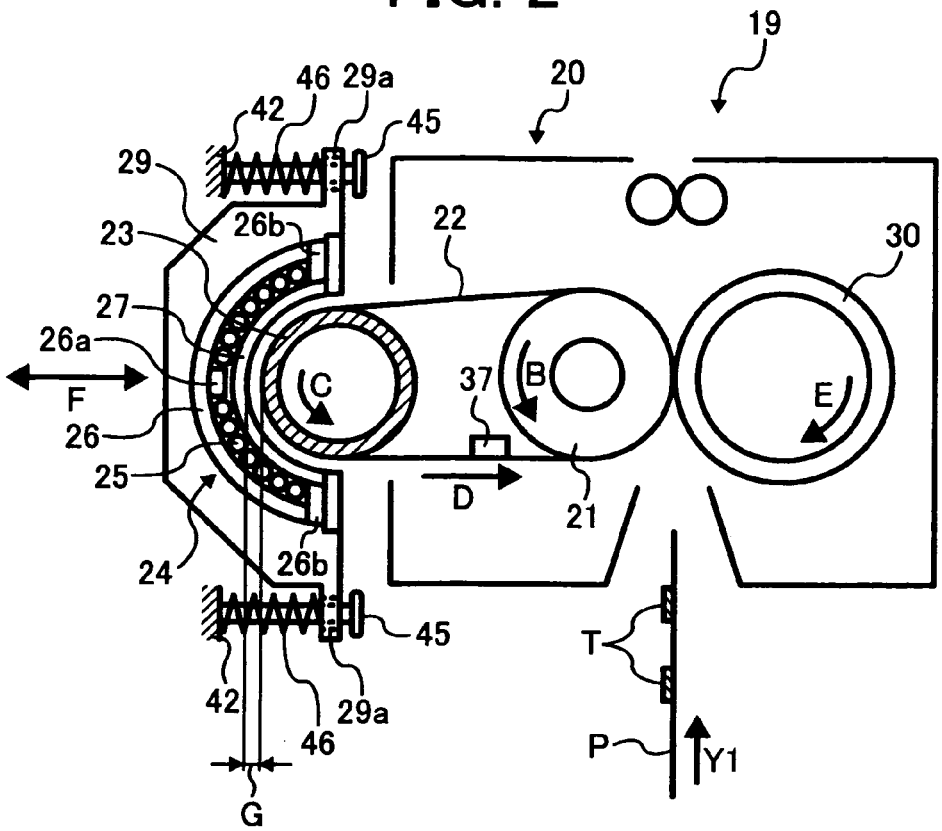
FIG. 2 is a schematic view of a fixing unit of the image forming apparatus shown in FIG. 1.

As illustrated in FIG. 2, the fixing unit 19 further includes an auxiliary fixing roller 21, a second holder 20, a support roller 23, an induction heater 24, a first holder 29, a board 42, guide pins 45, springs 46, and a thermistor 37. The first holder 29 includes holes 29*a*.

The auxiliary fixing roller 21 includes a core including stainless steel and an elastic layer including a silicone rubber formed on a surface of the core. The elastic layer has a thickness in a range of from about 1 mm to about 5 mm and an asker hardness in a range of from about 30 degrees to about 60 degrees. The second holder 20 forms a part of a housing of the fixing unit 19 and supports the auxiliary fixing roller 21 via bearings. A driver (not shown) drives and rotates the auxiliary fixing roller 21 in a rotating direction B.

The support roller 23 rotates in a rotating direction C and functions as a heat generator for generating heat. The support roller 23 includes a cylinder having a low heat capacity and including a magnetic, metallic material. The magnetic, metallic material includes iron, cobalt, nickel, stainless steel, and/or an alloy of those. The cylinder has an outside diameter of about 20 mm, for example, and a thickness of about 1 mm, for example.

The fixing belt 22 is looped over the support roller 23 and the auxiliary fixing roller 21 to rotate in a rotating direction D and functions as the heat generator. The fixing belt 22 is formed in an endless belt shape and has a multi-layered structure. Specifically, the fixing belt 22 includes a base layer including polyimide, a heat generating layer including a metal (e.g., nickel and/or silver), an elastic layer including a silicone rubber, and a releasing layer including a fluorine compound. The releasing layer releases toner T from a surface of the fixing belt 22. The heat generating layer may include a plurality of layers. Specifically, the heat generating layer may include a resin layer including a fluorocarbon resin, a polyimide resin, a polyamide resin, a polyamide-imide resin, a PEEK (polyetheretherketone) resin, a PES (polyethersulfone) resin, and/or a PPS (polyphenylene sulfide) resin and a metal layer including nickel.

The pressure roller 30 rotates in a rotating direction E and includes a cylinder including aluminum and/or copper and an elastic layer including a fluorocarbon rubber and/or a silicone rubber. The elastic layer has a thickness in a range of from about 0.5 mm to about 2.0 mm and an asker hardness in a range of from about 60 degrees to about 90 degrees. The pressure roller 30 presses the auxiliary fixing roller 21 via the fixing belt 22. The recording sheet P fed in a direction Y1 is conveyed through a portion where the pressure roller 30 contacts the fixing belt 22 (i.e., the nip formed under pressure between the pressure roller 30 and the fixing belt 22).

The induction heater 24 includes a coil guide 27, a coil 25 (i.e., an exciting coil), a core 26 (i.e., an exciting coil core), a center core 26*a*, and side cores 26*b*. The coil guide 27 is disposed to cover a portion of an outer circumferential surface of the fixing belt 22 of which an inner circumferential surface is contacted by the support roller 23. The coil 25 includes litz wires including bunched fine wires coiled and extended in a direction perpendicular to the direction Y1 (i.e., in a width direction of the fixing belt 22 perpendicular to a sheet conveyance direction). The coil guide 27 is formed in a semi-cylindrical shape and includes a heat-resistant resin material. The coil guide 27 holds the coil 25. The core 26 is formed in a semi-cylindrical shape and includes a ferromagnet (e.g., ferrite) having a relative permeability in a range of from about 1,000 to about 3,000. The side cores 26*b* are disposed symmetrically with respect to the center core 26*a* to effectively generate a magnetic flux toward the heat generators. The core 26 is disposed to oppose the coil 25 extended in the width direction of the fixing belt 22 perpendicular to the sheet conveyance direction (i.e., in a longitudinal direction of the support roller 23).

The first holder 29 forms a part of the housing of the fixing unit 19 and supports the induction heater 24 in a manner that the induction heater 24 moves in directions F. Specifically, the guide pins 45 are fixed on the board 42 provided in the image forming apparatus 1 and support the first holder 29 supporting the induction heater 24. The guide pin 45 is inserted into the hole 29*a* provided in the first holder 29. The spring 46 is provided on the guide pin 45 and functions as a second force applier for applying a force which moves the first holder 29 supporting the induction heater 24 toward the support roller 23. The guide pin 45 has an outside diameter smaller than a hole diameter of the hole 29*a* to allow movement in a radial direction. The thermistor 37 contacts the inner circumferential surface of the fixing belt 22. The thermistor 37 includes a temperature-sensitive element having an increased thermal response and detects a temperature of the inner circumferential surface of the fixing belt 22. Heating by the induction heater 24 is adjusted based on the detection of the thermistor 37. A thermostat (not shown) contacts an outer circumferential surface of the support roller 23 and detects a temperature of the outer circumferential surface of the support roller 23. When the temperature of the outer circumferential surface of the support roller 23 exceeds a predetermined temperature, power distribution to the induction heater 24 stops to restrict heating of the support roller 23 performed by the induction heater 24.

Figure 3:
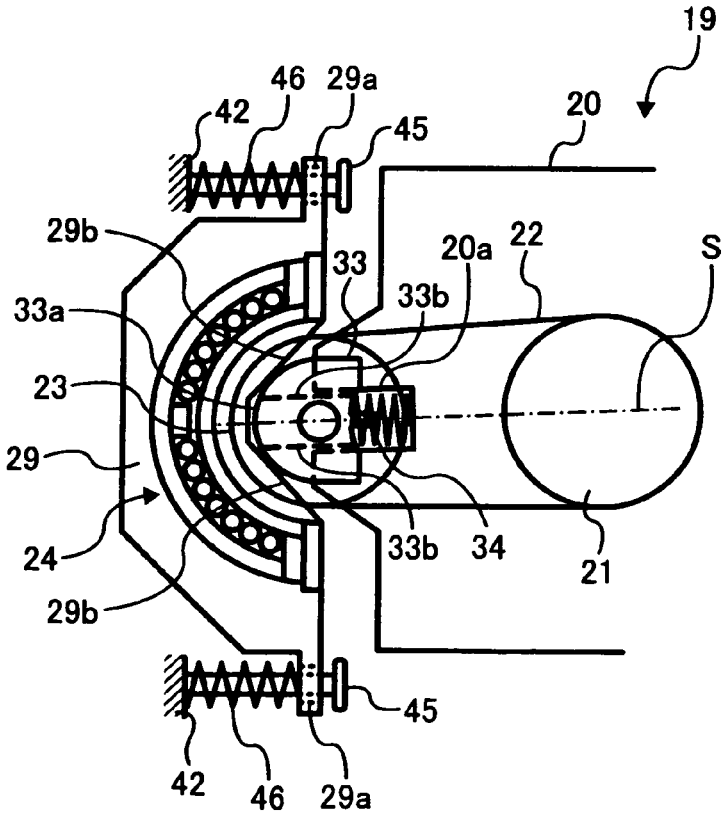
FIG. 3 is a schematic view of a position adjusting mechanism of the fixing unit shown in FIG. 2.

As illustrated in FIG. 3, the fixing unit 19 further includes bearings 33 for supporting both ends of a shaft of the support roller 23. Each of the bearings 33 includes a curved surface 33*a* formed in a curved shape and grooves 33*b*. The first holder 29 includes a slant 29*b* formed in a V-like shape. The curved surface 33*a* contacts the slant 29*b* at two positions.

The second holder 20 supports the support roller 23 via the bearings 33 in a manner that the support roller 23 moves on a virtual line S which extends through rotating axes of the support roller 23 and the auxiliary fixing roller 21. The second holder 20 supports the bearings 33 and includes guides 20*a* for guiding the bearings 33 (i.e., an axis of the shaft of the support roller 23) to move on the virtual line S. The guide 20*a* includes a spring 34 which functions as a first force applier for applying a force which pushes the bearing 33 (i.e., the support roller 23) toward the slant 29*b* (i.e., the induction heater 24). The spring 34 also functions as a force applier for tensioning the fixing belt 22.

Figure 4:
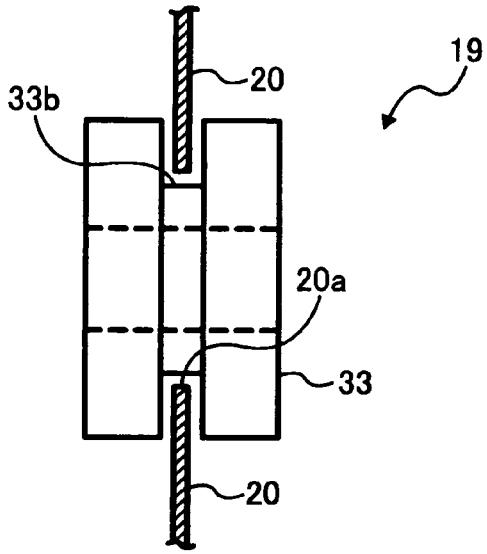
FIG. 4 is a side view of the position adjusting mechanism shown in FIG. 3.

As illustrated in FIG. 4, the groove 33*b* engages with the guide 20*a* so that the bearing 33 is slidably guided by the guide 20*a*.

With the above-described structure, when the thermally expanded auxiliary fixing roller 21 moves the support roller 23, the induction heater 24 may move in accordance with the movement of the support roller 23. Thus, a gap G between the induction heater 24 and the fixing belt 22 or the support roller 23 illustrated in FIG. 2 may be maintained at a certain distance.

The second holder 20 supports the auxiliary fixing roller 21 and the pressure roller 30 in addition to the support roller 23. The second holder 20 may be separated from the first holder 29 which supports the induction heater 24. As described above, the guide pins 45 flexibly support the first holder 29. Thus, variations in position of the support roller 23 may be reduced or prevented when the first holder 29 and the second holder 20 are positioned.

When a fixing operation is repeated on recording sheets P continuously fed into the fixing unit 19, the auxiliary fixing roller 21 may thermally expand to have a greater outside diameter. As a result, the fixing belt 22 may move the support roller 23 closer to the auxiliary fixing roller 21. However, the bearing 33 contacts the slant 29*b*. Thus, the gap G between the coil 25 and the support roller 23 may be maintained to a certain distance. The fixing belt 22 is uniformly tensioned because the support roller 23 moves in one direction on the virtual line S. Parallelism between the support roller 23 and the auxiliary fixing roller 21 may not be reduced. Thus, the fixing belt 22 may not slip off the support roller 23 and the auxiliary fixing roller 21 while the fixing belt 22 rotates in the rotating direction D.

The following describes operations of the fixing unit 19 having the above-described structure. As illustrated in FIG. 2, the auxiliary fixing roller 21, which rotates in the rotating direction B, rotates the fixing belt 22 in the rotating direction D. Accordingly, the support roller 23 rotates in the rotating direction C and the pressure roller 30 rotates in the rotating direction E. While passing under the induction heater 24, the fixing belt 22 is heated by a magnetic flux generated by the induction heater 24.

Specifically, a power source (not shown) applies a high-frequency alternating current in a range of from about 10 kHz to about 1 MHz (preferably from about 20 kHz to about 800 kHz) to the coil 25 to form magnetic lines of force between the core 26 and an inside core (not shown). Directions of the magnetic lines of force alternately switch in opposite directions to form an alternating magnetic field. The magnetic field induces an eddy current on the surface of the support roller 23 and the heat generating layer of the fixing belt 22. Electric resistances of the support roller 23 and the heat generating layer of the fixing belt 22 generate Joule heat to heat the support roller 23 and the heat generating layer of the fixing belt 22. The fixing belt 22 is heated by the heated support roller 23 and the heated heat generating layer of the fixing belt 22.

A portion on the outer circumferential surface of the fixing belt 22 heated by the induction heater 24, when reaching the nip formed under pressure between the fixing belt 22 and the pressure roller 30, heats and melts the toner T on the recording sheet P conveyed through the nip formed under pressure between the fixing belt 22 and the pressure roller 30. Specifically, the recording sheet P having the toner image formed as described above is guided by a guide (not shown) and is conveyed in the direction Y1 to the nip formed under pressure between the fixing belt 22 and the pressure roller 30. While the recording sheet P is conveyed through the nip formed under pressure between the fixing belt 22 and the pressure roller 30, the fixing belt 22 and the pressure roller 30 respectively apply heat and pressure to the recording sheet P to fix the toner image on the recording sheet P. The recording sheet P having the fixed toner image is fed out of the nip formed under pressure between the fixing belt 22 and the pressure roller 30.

The portion on the outer circumferential surface of the fixing belt 22, after passing the nip formed under pressure between the fixing belt 22 and the pressure roller 30, passes under the induction heater 24 again. The above-described operations are repeated to complete the fixing operation.

Even when a position of the support roller 23 or the fixing belt 22 with respect to the induction heater 24 is changed when the recording sheets P are continuously fed into the fixing unit 19, the induction heater 24 is moved to maintain the gap between the induction heater 24 and the support roller 23 or the fixing belt 22 to a certain distance. Thus, heat generating efficiencies of the support roller 23 and the fixing belt 22 may be constantly maintained.

As described above, according to this non-limiting exemplary embodiment, the position of the induction heater 24 is changed in accordance with the changed position of the support roller 23 or the fixing belt 22. Even when an element including the auxiliary fixing roller 21 is thermally deformed, change in the distance between the induction heater 24 and the support roller 23 or the fixing belt 22 may be reduced or prevented. As a result, problems including change in heat generating efficiency may be reduced or prevented.

According to this non-limiting exemplary embodiment, the pressure roller 30 opposes the auxiliary fixing roller 21 via the fixing belt 22. However, the pressure roller 30 may contact an area on the outer circumferential surface of the fixing belt 22, where neither the support roller 23 nor the auxiliary fixing roller 21 contacts the inner circumferential surface of the fixing belt 22, if the induction heater 24 is configured to move in accordance with the movement of the support roller 23 or the fixing belt 22.

According to this non-limiting exemplary embodiment, the fixing belt 22 having the heat generating layer and the support roller 23 are used as the heat generators. However, any one of the fixing belt 22 and the support roller 23 may be used as the heat generator, if the induction heater 24 is configured to move in accordance with the movement of the support roller 23 or the fixing belt 22.

Figure 5:
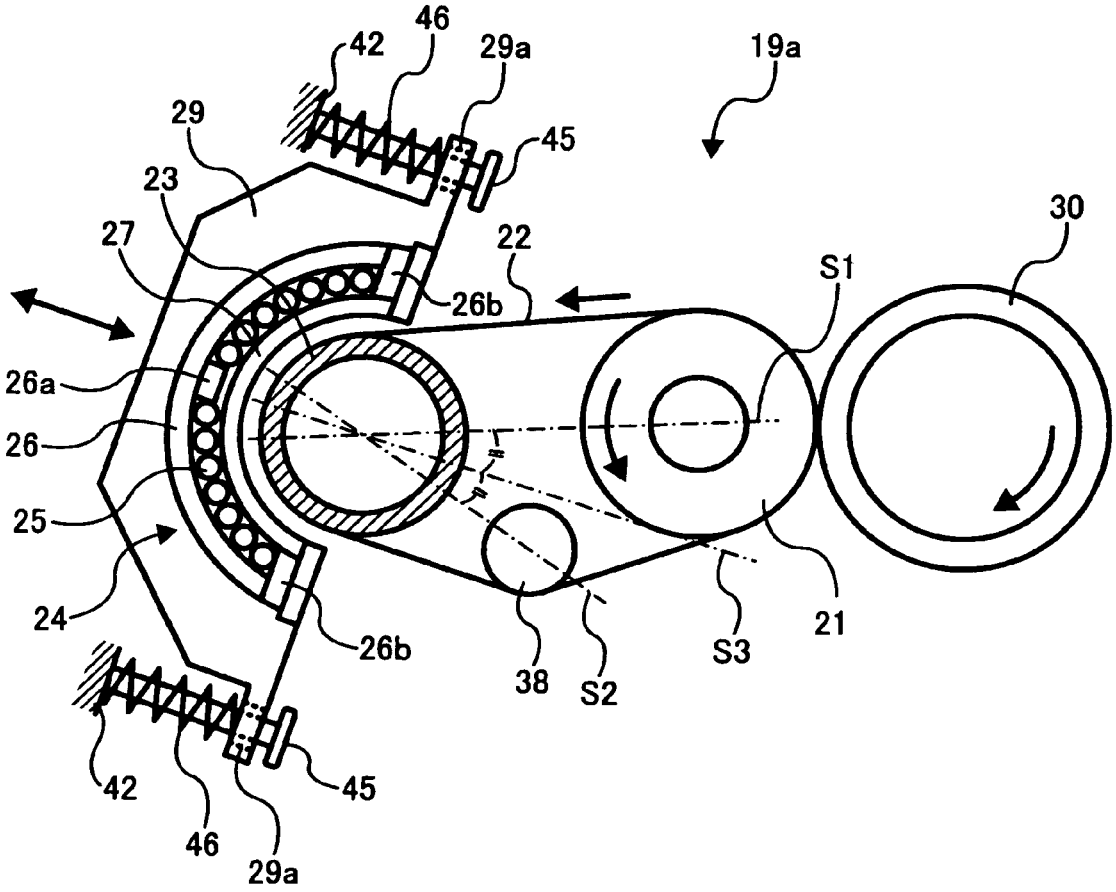
FIG. 5 is a schematic view of a fixing unit of the image forming apparatus shown in FIG. 1 according to another exemplary embodiment of the present invention.

FIG. 5 illustrates a fixing unit 19*a* according to another exemplary embodiment of the present invention. The fixing unit 19*a* includes a tension roller 38 for tensioning the fixing belt 22. Elements of the fixing unit 19*a* other than the tension roller 38 are common to the fixing unit 19.

The tension roller 38 is disposed between the support roller 23 and the auxiliary fixing roller 21 and contacts the inner circumferential surface of the fixing belt 22 to tension the fixing belt 22. The second holder 20 supports the tension roller 38 and the auxiliary fixing roller 21. The spring 34 presses the support roller 23 to tension the fixing belt 22.

The first holder 29 supports the induction heater 24 in a manner that the induction heater 24 moves on a third virtual line S3. The third virtual line S3 is formed between a first virtual line S1 which extends through the rotating axes of the support roller 23 and the auxiliary fixing roller 21 and a second virtual line S2 which extends through the rotating axes of the support roller 23 and the tension roller 38. The first virtual line S1 and the third virtual line S3 form an angle having a degree common to an angle formed by the second virtual line S2 and the third virtual line S3. Specifically, the guide 20*a* guides the bearing 33 to move on the third virtual line S3.

When the support roller 23 or the fixing belt 22 opposing to the induction heater 24 moves substantially on the third virtual line S3, the induction heater 24 supported by the first holder 29 moves to maintain the gap between the induction heater 24 and the support roller 23 or the fixing belt 22 to a certain distance. Accordingly, a gap between the center core 26*a* or the side core 26*b* and the support roller 23 or the fixing belt 22 is also maintained to a certain distance. Thus, heat generating efficiencies of the support roller 23 and the fixing belt 22 may be constantly maintained.

As described above, according to this non-limiting exemplary embodiment, the position of the induction heater 24 is changed in accordance with the changed position of the support roller 23 or the fixing belt 22. Even when an element including the auxiliary fixing roller 21 is thermally deformed, change in the distance between the induction heater 24 and the support roller 23 or the fixing belt 22 may be reduced or prevented. As a result, problems including change in heat generating efficiency may be reduced or prevented.

Figure 6:
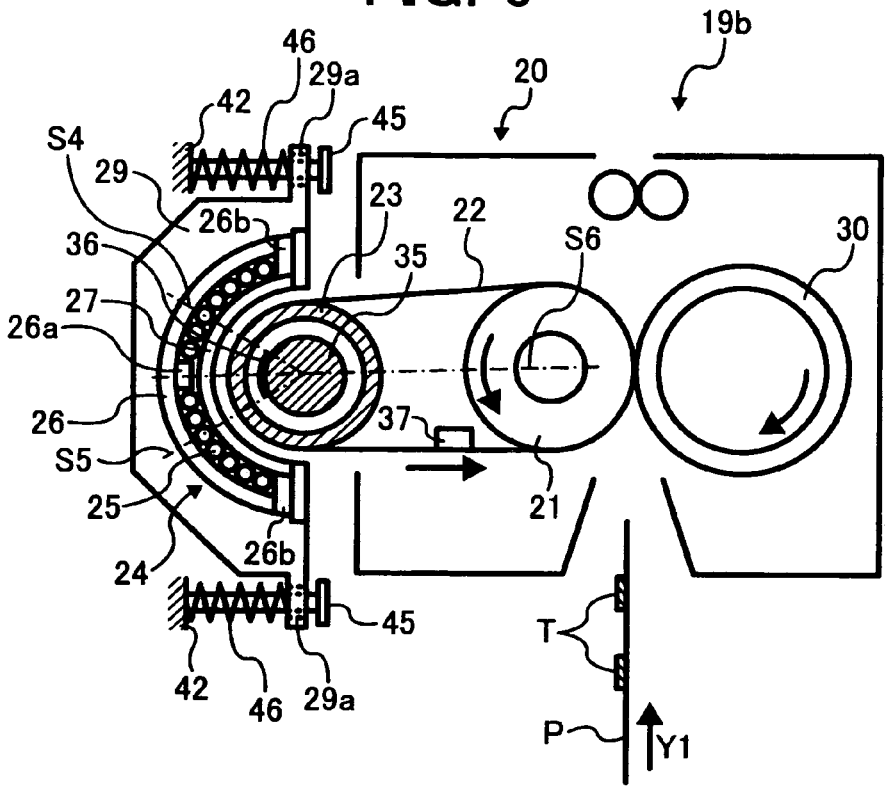
FIG. 6 is a schematic view of a fixing unit of the image forming apparatus shown in FIG. 1 according to yet another exemplary embodiment of the present invention.
Figure 7:
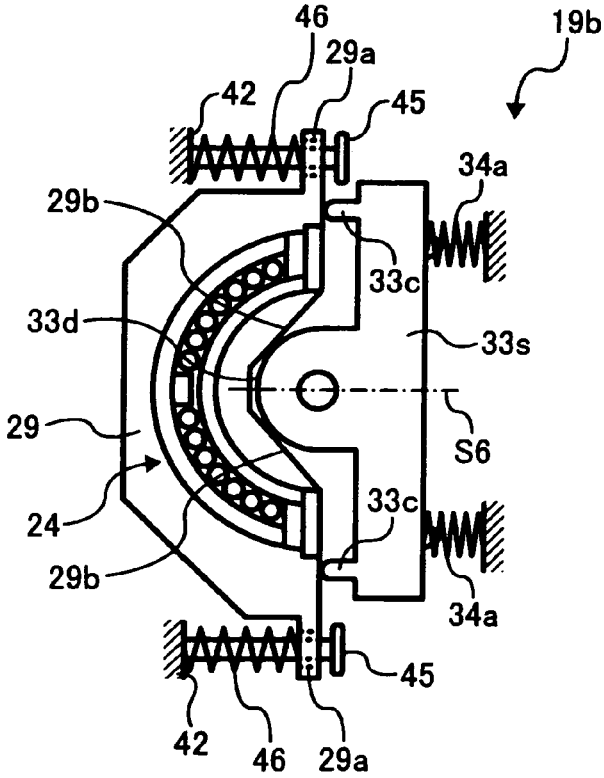
FIG. 7 is a schematic view of a position adjusting mechanism of the fixing unit shown in FIG. 6.

FIGS. 6 and 7 illustrate a fixing unit 19*b* according to yet another exemplary embodiment of the present invention. The fixing unit 19*b* includes an inside core 35, magnetic flux adjusters 36, bearings 33*s*, and springs 34*a*. Elements of the fixing unit 19*b* other than the inside core 35, the magnetic flux adjusters 36, the bearings 33*s*, and the springs 34*a* are common to the fixing unit 19.

The inside core 35 includes a ferromagnet (e.g., ferrite) and is disposed inside the support roller 23 in a manner that the inside core 35 opposes the coil 25 via the fixing belt 22. The coil 25 may effectively form an alternating magnetic field between the core 26 and the inside core 35.

Each of the magnetic flux adjusters 36 includes a low-resistance material including aluminum and/or copper and forms a triangle-like shape in the direction perpendicular to the sheet conveyance direction (i.e., in the longitudinal direction of the support roller 23). The magnetic flux adjusters 36 are attached to both end portions on the outer circumferential surface of the inside core 35 in the direction perpendicular to the sheet conveyance direction (i.e., in the longitudinal direction of the support roller 23). The inside core 35 rotates independently of the support roller 23. The inside core 35 rotates for a certain angle to change positions of the magnetic flux adjusters 36 with respect to the center core 26*a* (i.e., to change areas on the magnetic flux adjusters 36, which oppose to the inside core 26*a*). Thus, heated areas on the support roller 23 and the fixing belt 22 may be changed in the direction perpendicular to the sheet conveyance direction (i.e., in the width direction of the fixing belt 22 perpendicular to sheet conveyance direction).

The magnetic flux generated in the alternating magnetic field formed by the coil 25 is concentrated near the center core 26*a* and the side cores 26*b*. Therefore, positioning the magnetic flux adjusters 36 with respect to the center core 26*a* and the side cores 26*b* may be important. If virtual lines S4 and S5 which respectively extend through a rotating axis of the inside core 35 (i.e., the rotating axis of the support roller 23) and both ends of the magnetic flux adjuster 36 in the rotating direction of the inside core 35 are not positioned with respect to a virtual line S6 which extends through the rotating axis of the inside core 35 and a center of the center core 26*a* in the rotating direction of the inside core 35 to form a proper angle, the heated areas on the support roller 23 and the fixing belt 22 may be changed in the direction perpendicular to the sheet conveyance direction (i.e., in the width direction of the fixing belt 22 perpendicular to the sheet conveyance direction).

According to this non-limiting exemplary embodiment, when the position of the support roller 23 is changed, the induction heater 24 including the center core 26*a* and the side cores 26*b* moves in a state that a relative position of the induction heater 24 with respect to the inside core 35 and the magnetic flux generators 36 is maintained. Thus, the desired areas on the support roller 23 and the fixing belt 22 may be heated in the direction perpendicular to the sheet conveyance direction (i.e., in the width direction of the fixing belt 22 perpendicular to the sheet conveyance direction).

As illustrated in FIG. 7, the bearings 33*s* support both ends of the shaft of the support roller 23 and each of the bearings 33*s* includes a plurality of protruding portions 33*c* and a curved surface 33*d*. The protruding portions 33*c* contact the first holder 29. The springs 34*a* function as the first force appliers for applying a force which pushes the bearing 33*s* toward the slant 29*b*. The springs 34*a* push the bearing 33*s* toward the induction heater 24 in a manner that the curved surface 33*d* contacts the slant 29*b*. The springs 46 function as the second force appliers for applying a force which moves the first holder 29 supporting the induction heater 24 toward the support roller 23. The springs 46 move the induction heater 24 toward the support roller 23 in a manner that the first holder 29 contacts the protruding portions 33*c*. Each of the bearings 33*s* may include one protruding portion 33*c* and may contact either the first holder 29 or the induction heater 24.

As described above, according to this non-limiting exemplary embodiment, the position of the induction heater 24 is changed in accordance with the changed position of the support roller 23 or the fixing belt 22. Even when an element including the auxiliary fixing roller 21 is thermally deformed, change in the distance between the induction heater 24 and the support roller 23 or the fixing belt 22 may be reduced or prevented. As a result, problems including change in heat generating efficiency may be reduced or prevented.

Figure 8:
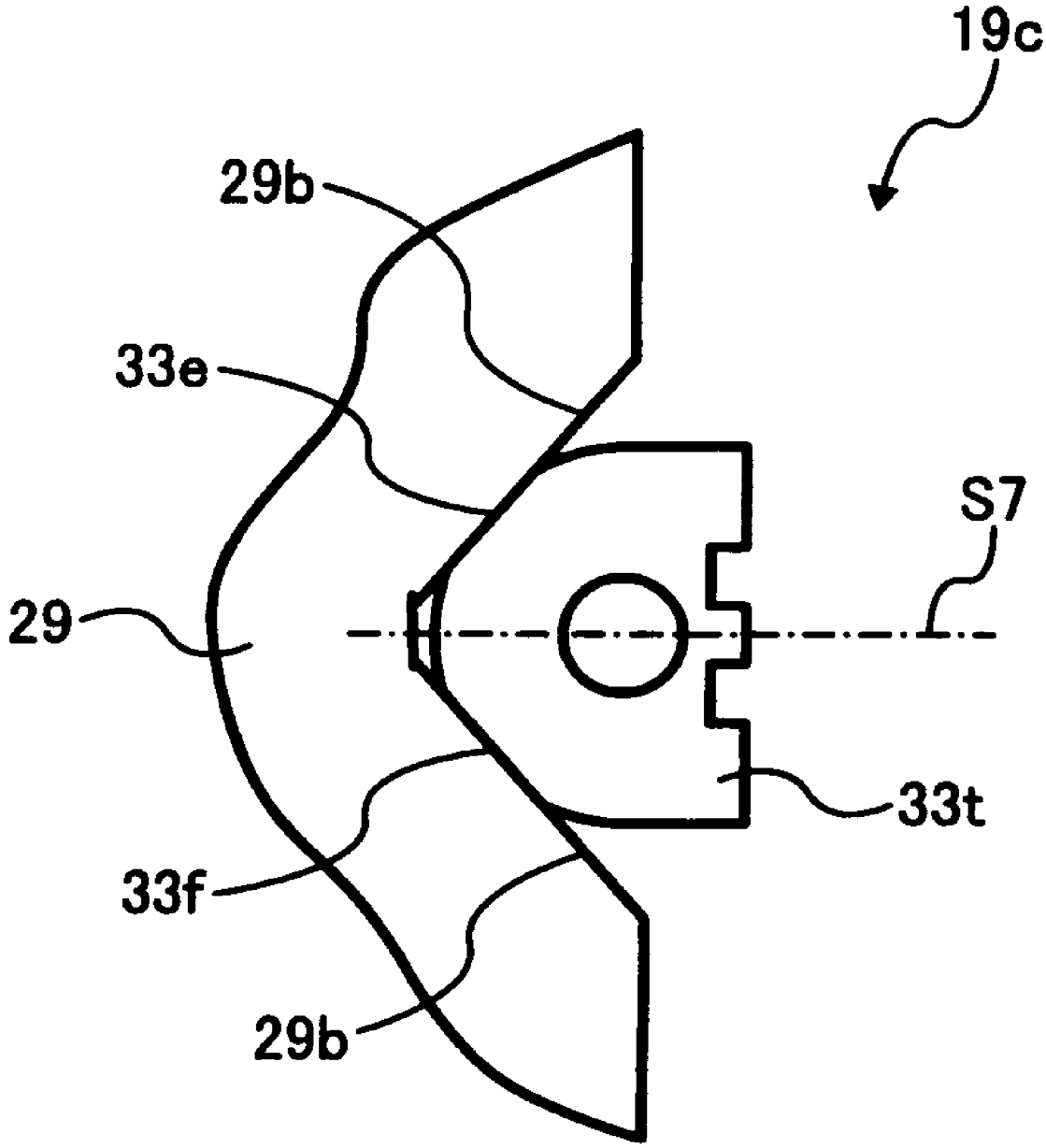
FIG. 8 is a schematic view of a position adjusting mechanism of a fixing unit of the image forming apparatus shown in FIG. 1 according to yet another exemplary embodiment of the present invention.

FIG. 8 illustrates a fixing unit 19*c* according to yet another exemplary embodiment of the present invention. The fixing unit 19*c* includes bearings 33*t*. Elements of the fixing unit 19*c* other than the bearings 33*t* are common to the fixing unit 19*b*.

According to this non-limiting exemplary embodiment, when the position of the support roller 23 is changed, the induction heater 24 including the center core 26*a* and the side cores 26*b* moves in the state that the relative position of the induction heater 24 with respect to the inside core 35 and the magnetic flux generators 36 is maintained. Thus, the desired areas on the support roller 23 and the fixing belt 22 may be heated in the direction perpendicular to the sheet conveyance direction (i.e., in the width direction of the fixing belt 22 perpendicular to the sheet conveyance direction).

As illustrated in FIG. 8, the bearings 33*t* support both ends of the shaft of the support roller 23 and each of the bearings 33*t* includes a plurality of plane surfaces 33*e* and 33*f*. The plane surfaces 33*e* and 33*f* are disposed on an outer circumferential surface of the bearing 33*t* and form a V-like shape. The springs 34*a* function as the first force appliers for applying a force which pushes the bearing 33*t* toward the slant 29*b*. The springs 34*a* press the bearing 33*t* toward the induction heater 24 in a manner that the plane surfaces 33*e* and 33*f* contact the slant 29*b*. The springs 46 function as the second force appliers for applying a force which moves the first holder 29 supporting the induction heater 24 toward the support roller 23. The springs 46 move the induction heater 24 on a virtual line S7 in a manner that the bearing 33*t* contacts the slant 29*b* at two positions when the position of the support roller 23 is changed.

As described above, according to this non-limiting exemplary embodiment, the position of the induction heater 24 is changed in accordance with the changed position of the support roller 23 or the fixing belt 22. Even when an element including the auxiliary fixing roller 21 is thermally deformed, change in the distance between the induction heater 24 and the support roller 23 or the fixing belt 22 may be reduced or prevented. As a result, problems including change in heat generating efficiency may be reduced or prevented.

The present invention has been described above with reference to specific exemplary embodiments. Note that the present invention is not limited to the details of the embodiments described above, but various modifications and improvements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image forming mechanism configured to form a toner image on a recording medium according to image data; and a fixing mechanism configured to fix the toner image on the recording medium and including:

an induction heater configured to generate a magnetic flux;

a heat generator disposed at a position opposite to the induction heater and configured to generate heat by the magnetic flux generated by the induction heater;

a position adjusting mechanism configured to adjust a position of the induction heater in conjunction with a displacement of the heat generator;

a first roller;

a second roller disposed at a position opposite to the induction heater via the heat generator and configured to support the heat generator together with the first roller when the heat generator is looped over the first and second rollers;

a third roller disposed at a position in contact with the heat generator and configured to apply pressure to the recording medium having the toner image; and a fourth roller configured to support the heat generator under tension together with the first and second rollers.

2. The image forming apparatus according to claim 1, wherein the heat generator is formed in a belt-like shape.

3. The image forming apparatus according to claim 1, wherein the second roller is configured to be another heat generator.

4. The image forming apparatus according to claim 1, wherein the first roller is disposed at a position opposite to the third roller via the heat generator.

5. The image forming apparatus according to claim 1, wherein the position adjusting mechanism is further configured to move the induction heater along a virtual line extending through rotating axes of the first and second rollers in conjunction with a displacement of the second roller.

6. The image forming apparatus according to claim 1, wherein the position adjusting mechanism is further configured to move the induction heater along a third virtual line formed between a first virtual line which extends through rotating axes of the first and second rollers and a second virtual line which extends through rotating axes of the second and fourth rollers, in conjunction with a displacement of the second roller, and wherein the first virtual line and the third virtual line form an angle having a degree common to an angle formed by the second virtual line and the third virtual line.

7. The image forming apparatus according to claim 1, further comprising:

an inside core disposed inside the second roller; and magnetic flux adjusters disposed inside the second roller and configured to adjust quantity of the magnetic flux reaching the inside core, wherein the position adjusting mechanism moves the induction heater in a state that the induction heater maintains a relative position with respect to the inside core and the magnetic flux adjusters, when a position of the second roller is changed.

8. The image forming apparatus according to claim 7, further comprising:

bearings configured to support the second roller at two edge portions thereof, each of the bearings including a curved surface and at least one protruding portion, wherein the position adjusting mechanism includes a first holder configured to support the induction heater and to contact the at least one protruding portion of each of the bearings and including a slant held in contact at two points with the curved surface of each of the bearings.

9. The image forming apparatus according to claim 8, further comprising:

first force appliers configured to push the bearings toward the slant of the first holder; and second force appliers configured to push the induction heater toward the second roller in a state that the first holder contacts the at least one protruding portion of each of the bearings.

10. The image forming apparatus according to claim 7, further comprising:

bearings configured to support both ends of a shaft of the second roller, each of the bearings including a curved surface and at least one protruding portion, wherein the position adjusting mechanism includes a first holder configured to support the induction heater and including a slant the curved surface of each of the bearings contacts at two positions, and wherein the induction heater contacts the at least one protruding portion of each of the bearings.

11. The image forming apparatus according to claim 10, further comprising:

first force appliers configured to push the bearings toward the slant of the first holder; and second force appliers configured to push the induction heater toward the second roller in a state that the induction heater contacts the at least one protruding portion of each of the bearings.

12. The image forming apparatus according to claim 9, further comprising:

bearings configured to support the second roller at two edge portions thereof, each of the bearings including an outer circumferential surface having a plurality of plane surfaces, wherein the position adjusting mechanism includes a first holder configured to support the induction heater and including a slant held in contact at two points with the plurality of the plane surfaces of each of the bearings and a second holder configured to support the bearings.

13. The image forming apparatus according to claim 12, further comprising:

first force appliers configured to push the bearings toward the slant of the first holder; and second force appliers configured to push the induction heater toward the second roller.

14. An image forming apparatus, comprising:

an image forming mechanism configured to form a toner image on a recording medium according to image data; and a fixing mechanism configured to fix the toner image on the recording medium and including:

an induction heater configured to generate a magnetic flux;

a heat generator disposed at a position opposite to the induction heater and configured to generate heat by the magnetic flux generated by the induction heater;

a position adjusting mechanism configured to adjust a position of the induction heater in conjunction with a displacement of the heat generator;

a first roller;

a second roller disposed at a position opposite to the induction heater via the heat generator and configured to support the heat generator together with the first roller in a state that the heat generator is looped over the first and second rollers;

a third roller disposed at a position in contact with the heat generator and configured to apply pressure to the recording medium having the toner image; and bearings configured to support the second roller at two edge portions thereof, each of the bearings including an outer circumferential surface having a curved surface, wherein the position adjusting mechanism includes a first holder configured to support the induction heater and including a slant held in contact at two points with the curved surface of each of the bearings and a second holder configured to support the bearings and including guides disposed along the virtual line on which the bearings move.

15. The image forming apparatus according to claim 14, further comprising:

first force appliers configured to push the bearings toward the slant of the first holder; and second force appliers configured to push the induction heater toward the second roller.

* * * * *

UNITED STATES PATENT AND TRADEMARK OFFICE

CERTIFICATE OF CORRECTION

PATENT NO. : 7,570,910 B2
APPLICATION NO. : 11/453035
DATED : August 4, 2009
INVENTOR(S) : Kenji Ishii It is certified that error appears in the above-identified patent and that said Letters Patent is hereby corrected as shown below:

Column 11, Line 33: "claim 9" should read --claim 7--.

Signed and Sealed this

Thirteenth Day of October, 2009

David J. Kappos

David J. Kappos
*Director of the United States Patent and Trademark Office*